US005105733A

United States Patent [19]

Vacquer

[11] Patent Number: 5,105,733

[45] Date of Patent: Apr. 21, 1992

[54] APPARATUS FOR SPRAYING A LIQUID TREATMENT AGENT ONTO CEREAL GRAINS

[75] Inventor: Frédéric Vacquer, Bihorel, France

[73] Assignee: Desinsectisation Moderne, Rouen, France

[21] Appl. No.: 424,679

[22] Filed: Oct. 20, 1989

[30] Foreign Application Priority Data

Oct. 21, 1988 [FR] France ..... 88 13853

[51] Int. Cl.[5] ..... B02B 1/04; B02B 5/00; B02B 7/00

[52] U.S. Cl. ..... 99/534; 99/516; 134/199; 239/565

[58] Field of Search ..... 99/516, 487, 534–536, 99/485, 646 S, 488; 134/199, 131; 239/565, 273, 266

[56] References Cited

U.S. PATENT DOCUMENTS

| | | | |
|---|---|---|---|
| 2,322,417 | 6/1943 | Christian | 134/199 |
| 3,009,825 | 11/1961 | O'Brien . | |
| 3,236,743 | 2/1966 | Pierson | 99/534 |
| 3,633,593 | 1/1972 | Slaats | 134/199 |
| 4,401,019 | 8/1983 | Leonov et al. | 99/471 |
| 4,508,029 | 4/1985 | Malone | 99/516 |
| 4,509,545 | 4/1985 | Trotter | 134/199 |
| 4,562,963 | 1/1986 | Butler | 239/273 |

FOREIGN PATENT DOCUMENTS

| | | | |
|---|---|---|---|
| 1343811 | 1/1974 | United Kingdom | 99/534 |

OTHER PUBLICATIONS

1986 Derwent Publications Ltd. Article (1 page) Abstract "Beet Seed Plishing Plant—Having Working Pt. as Water Filled Main Line, Housing Bushes with Apertures, Having Rought Surfaces".

*Primary Examiner*—Timothy F. Simone
*Attorney, Agent, or Firm*—Schweitzer Cornman & Gross

[57] ABSTRACT

The invention relates to an apparatus for spraying a liquid treatment agent onto cereal grains. it consists of at least one tubular frame (1 . . . 8) provided with at least one row of perforations (1), the interior of the frame being connected to a pressurized source of supply of a liquid treatment agent for cereal grains through a supply line (9), the said frame being of such a size as to surround an opening in a structure through which cereal grains are made to flow by gravity or under pressure.

6 Claims, 2 Drawing Sheets

GRAIN IN 17
11
5
GRAIN OUT
4
1
8
10
6
15
14
GRAIN OUT
3
12
2
7
13
9b
9a
16
P

APPARATUS FOR SPRAYING A LIQUID TREATMENT AGENT ONTO CEREAL GRAINS

BACKGROUND OF THE INVENTION

The present invention relates to an apparatus for spraying a liquid treatment agent, such as for example a dye intended to accomplish the denaturing of cereal grains while they are in movement, or a liquid insecticide, or also an agent such as a dust suppressing oil.

The coloring of cereals is generally performed manually with such rudimentary devices as a lance and a rake in grain-storage space in stationary and/or mobile installations, particularly in the holds of ships.

This operation calls for the employment of personnel, who then have to work under frequently difficult conditions, and the rudimentary methods employed accomplish usually no more than an imperfect impregnation of the treated grains.

SUMMARY OF THE PRESENT INVENTION

The present invention undertakes to construct an apparatus that will assure a perfect impregnation of cereal grains with a treatment agent, such as a dye or an insecticide, during the transfer of the grains, for example when the grains are being loaded into the hold of a ship.

The apparatus in accordance with the invention is characterized by the fact that it is constituted of at least one tubular frame provided with at least one row of perforations, the interior of which is connected by a supply line to a source for supplying under pressure a liquid agent for heat treatment of cereal grains, the said frame being of such a size that it can surround an opening in a structure, through which the grains are made to flow by gravity under pressure. In one embodiment the structure can be a duct, particularly, a vertical duct, particularly one of circular cross section, associated with a grain loading portal, the apparatus according to the invention then being of a circular shape and being affixed around the bottom end of the duct. In this embodiment, a protective skirt, particularly for protection against the effects of the wind, can be affixed around the bottom end of the duct around which the apparatus according to the invention is mounted. For ducts of other shapes the shape of the frame constituting the apparatus of the invention can be modified.

Advantageously, the apparatus of the invention is made by assembling a plurality of tubular sections joined together by elbows, each of the tubular sections being provided with perforations and arranged to be able to turn in the connecting elbows. In this case the liquid agent for treatment of grains can be delivered through one of the elbows.

Thus, it is possible to produce, in accordance with the invention, apparatus in the form of polygonal frames, partially square or rectangular frames, adapted for fastening on openings of matching cross section in structures such as, for example, apparatus known by the name of 'arrimeurs" [stowers] and consisting of an enclosure affixed to the end of a swiveling vertical duct carrying cereal grains flowing by gravity or under pressure, the said enclosure being adapted for introduction into the hold of a ship from a loading partial, the enclosure having one or more openings, generally of square or rectangular cross section, around which or around each of which an apparatus in accordance with the invention can be installed.

If a plurality of frames in accordance with the invention are mounted on the same structure, it is possible to provide a common supply line from a source of liquid treatment agent, the line being connected to both frames.

The apparatus, or each apparatus, according to the invention can be mounted around the corresponding grain passage opening by any appropriate mounting means, particularly one permitting a detachable connection, for example by means of adhesive tape or conventional mechanical attaching means.

For the purpose of a better understanding of the invention a description will now be given of an embodiment, as an example which by no means limits it, in conjunction with the appended drawing wherein:

DETAILED DESCRIPTION OF THE INVENTION

The apparatus shown has four tubular sections of preferably circular cross section 1, 2, 3 and 4, joined together by elbow couplings 5, 6, and 8, and mounted rotatably in the couplings.

For this purpose, each of the sections 1, 2, 3, 4, has threaded ends which can be screwed into matching threads provided in the couplings 5, 6, 7 and 8.

Figure 1:
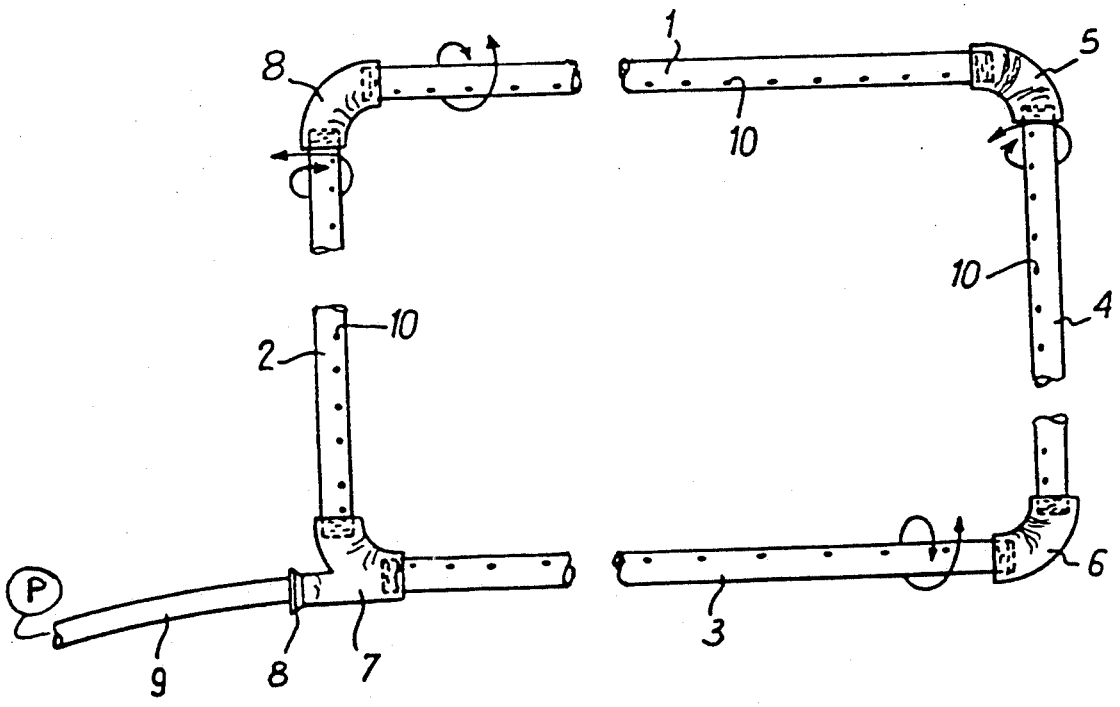
FIG. 1 represents one particular embodiment of the apparatus in accordance with the invention.

Thus, each of the sections 1, 2, 3, 4, can turn as indicated by the arrows in FIG. 1.

Coupling 7 furthermore has a connection 8 for attaching a supply line, preferably a flexible hose 9, connected to a source of supply under pressure (from source p), of an agent for the treatment of cereal grains, particularly of dye or disinfectant.

As it can be seen in FIG. 1, each of the sections 1, 2, 3, 4, is provided with a row of perforations 10, 11; it is of course possible to provide several rows of perforations.

The rotation of the sections 1, 2, 3, 4, with respect to the couplings 5, 6, 7 and 8, permits the perforations 10 of each of the sections to be aimed once the apparatus of the invention has been put in place and affixed around an opening through which the cereal grains are made to pass.

Figure 2:
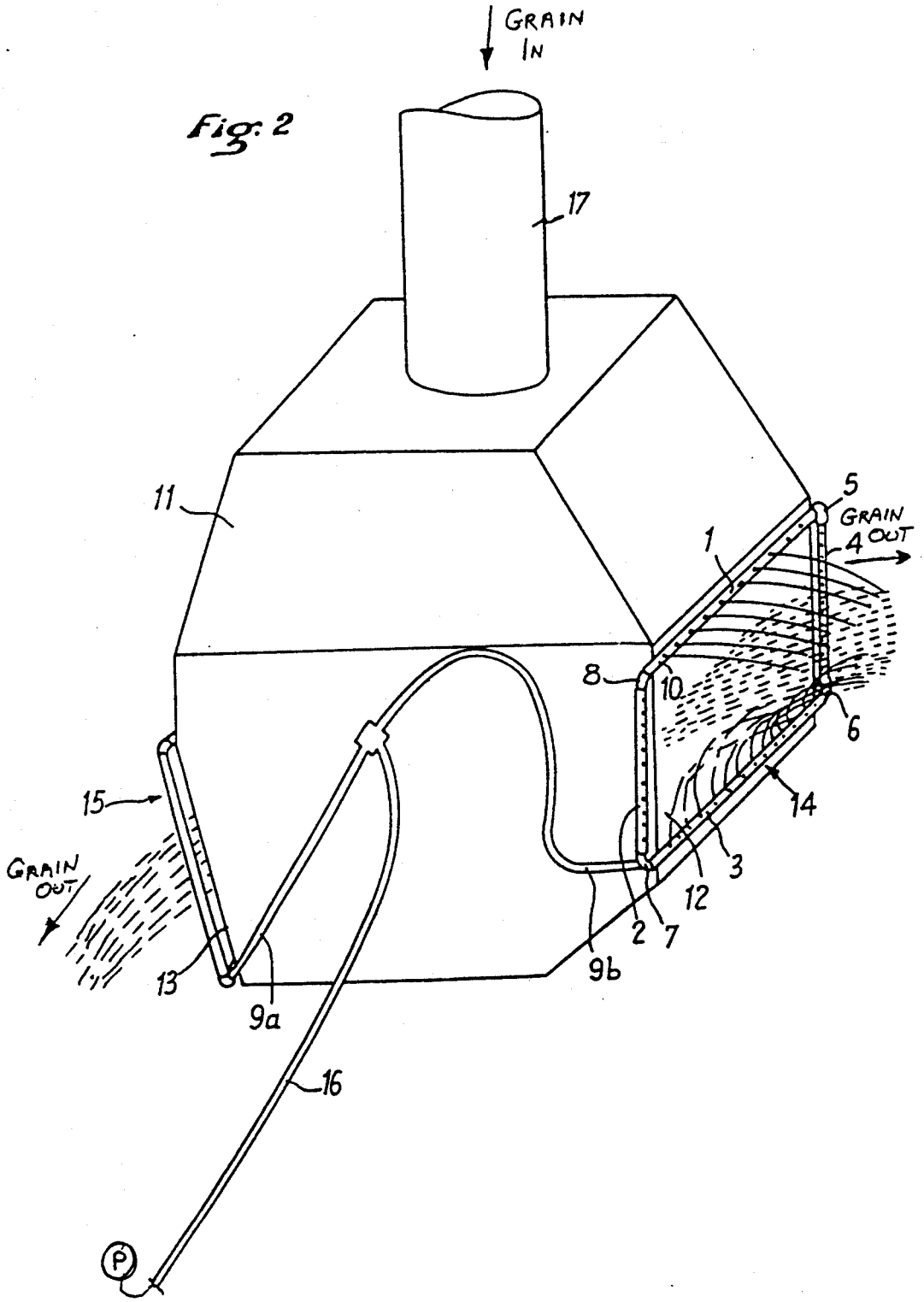
FIG. 2 represents an installation of the "arrimeur" type using two frames such as those shown in FIG. 1.

An installation using two frames like those illustrated in FIG. 1 is shown in FIG. 2.

This is an installation known as an "arrimeur" [stower] and having a structure in the form of a polyhedral enclosure 11 provided with openings of rectangular section 12 and 13 around which are paced the frames according to the invention, generally identified as 14 and 15, respectively.

In the illustrated embodiment, a supply line 16 (under pressure p) carrying liquid treatment agent and having two branch lines **9*a* and 9*b* connected to frames 14 and 15**, respectively.

Each of the frames 14 and 15 is fastened by any appropriate means to the walls of the structure 11 around the respective openings 12 and 13, and, once each of the frames 14 and 15 is in place, the respective frame sections provided with perforations are adjusted so as to aim the resultant jets in the direction of the flow of cereal grains passing through the respective openings 12 and 13 so as to achieve a uniform impregnation of the grains.

Although the invention has been described in connection with one particular mode of embodiment, it is quite evident that it is by no means limited thereto, and that different variants and modifications can be made in it without thereby departing either from its scope or from its spirit. In particular it is possible, in an embodiment that is not illustrated but can be used in the case of installations having no cereal grain loading structure like that illustrated in FIG. 2, to mount an apparatus in frame form in accordance with the invention directly at the bottom end of the duct 17 to whose end the structure 11 is affixed; in that case the frame has a shape matching the section of the duct 17, particularly a circular shape, and is affixed by any appropriate means in the vicinity of the bottom end of the duct 17. In this case too, a skirt for protection against the wind can surround this end of the duct 17.

Furthermore, the invention is not limited to application to a grain ship loading portal, but it can also be used on cereal grains being carried in other installations, particularly flour mills, especially at the end of a duct.

I claim:

1. Apparatus for spraying a liquid treatment agent onto a stream of flowing grains in transit, comprising:

(a) a polyhedral grain housing enclosure affixed to the lower end of a vertical grain inlet duct and having at least one grain outlet opening for issuing a stream of grain;

(b) at least one tubular frame mounted adjacent said opening and provided with at least one row of perforations;

(c) a supply line adapted to communicate between a source of pressurized liquid treatment agent for said grains and said frame;

(d) said frame being correspondingly dimensioned and shaped so as to surround closely said outlet opening through which said grains are adapted to flow; and (e) whereby a liquid treatment agent may be sprayed through said perforations on said grains.

2. Apparatus according to claim 1, characterized by the fact that the outlet and the frame have a closed two-dimensional shape.

3. Apparatus according to claim 2 in which said closed shape is generally circular or rectangular.

4. Apparatus according to claim 1, characterized by the fact that:

(a) the frame includes a plurality of tubular sections;

(b) a series of elbows interconnect said tubular sections;

(c) each of the tubular sections includes a portion of said perforations; and (d) said tubular sections are mounted to rotate within the elbows to permit said perforations to function as nozzle which may be aimed inwardly toward the flow of grains exiting said outlet and passing through said frame.

5. Apparatus according to claim 4, characterized by the fact that:

(a) the tubular sections have threaded ends;

(b) the connecting elbows have matching internal threads; and (c) the selective rotations of the threaded tubular sections in the threaded connecting elbows accommodate precise aiming of the spray emanating from the perforations.

6. Apparatus according to claim 1, which includes a plurality of frames having a common pressurized fluid treatment supply line.

* * * * *